US005273119A

United States Patent [19]

Dick

[11] Patent Number: 5,273,119

[45] Date of Patent: Dec. 28, 1993

[54] TENSION RELEASE FOR FIRE PROTECTION SYSTEM

[76] Inventor: John K. Dick, 152 Cheese Factory Rd., Honeoye Falls, N.Y. 14472

[21] Appl. No.: 956,370

[22] Filed: Oct. 5, 1992

[51] Int. Cl.[5] ..... A62C 37/48

[52] U.S. Cl. ..... 169/42

[58] Field of Search ..... 169/42

[56] References Cited

U.S. PATENT DOCUMENTS 3,448,808 6/1969 Scofield et al. ..... 169/42 X 3,463,236 8/1969 Flajole et al. ..... 169/42

*Primary Examiner*—David M. Mitchell

*Assistant Examiner*—Andrew C. Pike

*Attorney, Agent, or Firm*—Hoffman Stone

[57] ABSTRACT

A trigger arrangement for a fire protection system of the kind in which a fire extinguisher is triggered by the relaxation of tension in a wire that is trained through a region to be protected and kept under tension. A fusible link forces a portion of the wire to lie along a curved path. When the fuse part of the link melts, the link releases the wire, allowing it to straighten out, thus increasing its overall length, relaxing the tension and triggering the extinguisher The link of the invention is simply an integral, laminated body in which the laminations, held together by an adhesive, fusible material, are formed with wire guide means for restraining the wire in a looped configuration so long as the laminations are held together.

2 Claims, 1 Drawing Sheet

TENSION RELEASE FOR FIRE PROTECTION SYSTEM

This invention relates to a novel tension release for fire protection systems of the kind commonly installed in restaurant kitchens. In systems of the kind of concern here a tensioned wire, or cable is trained through the area it is desired to protect, and devices are connected to the wire at each so-called danger point to allow the wire to elongate whenever the temperature at any danger point exceeds a predetermined value. Elongation of the wire triggers activation of a fire extinguishing s y stem.

In the older systems, known as "crimp and hook", the tension wire was cut at each hazard point, and re-connected by crimped on Shook couplings with a fuse between the new ends of the wire. A typical system of this kind is shown in U.S. Pat. No. 3,448,808, issued June 10, 1968 to W. Scofield, et al. It is a relatively difficult system to install because measurements must be fairly accurate to ensure that each fuse becomes located at the desired hazard point.

The particular difficulty entailed in ensuring accuracy of fuse placement was overcome by an arrangement described in U.S. Pat. No. 3,463,236, issued Aug. 26, 1969 to Flajole, et al, in which a linkage is provided for installation at each hazard point for increasing the length of wire contained in a leg. The linkage takes up a length of the wire, shortening its overall length by forming a partial loop in it. The loop is maintained by a fusible member between two of the links in the linkage which collapses when the fuse melts, allowing the overall length of the wire to increase by the length of the loop.

SUMMARY OF THE INVENTION

The present invention may most easily be thought of as a simplification of the Flajole, et al system. Instead of providing a separate linkdage and a fuse to keep it rigid, in accordance with this invention the fuse itself constitutes the linkage. I may consist, for example, of simply two similar leaves, or plates of metal soldered together face to face, and with guide means for holding the tension wire of the fire system in position trained along the opposite, exposed faces of the leaves. When the solder melts, the leaves are pulled apart from each other by the tension on the wire, allowing the overall, end-to-end length of the wire to increase by approximately twice the length of the link.

BRIEF DESCRIPTION OF THE DRAWING

A presently preferred embodiment of the invention will now be described in connection with the drawing, wherein.

DETAILED DESCRIPTION OF THE PREFERRED EMBODIMENT

The link according to the presently preferred embodiment of the invention includes two leaves 12 and 14 that may be likened in shape to sticks of chewing gum. They are secured in face-to-face position by a fusible adhesive material 16 such as solder selected to melt at a predetermined temperature.

Figure 1:
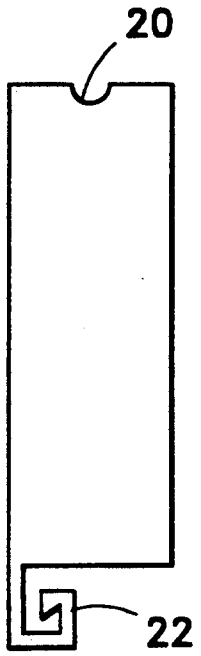
FIG. 1 is a front elevational view of a fusible link according to the invention.
Figure 2:
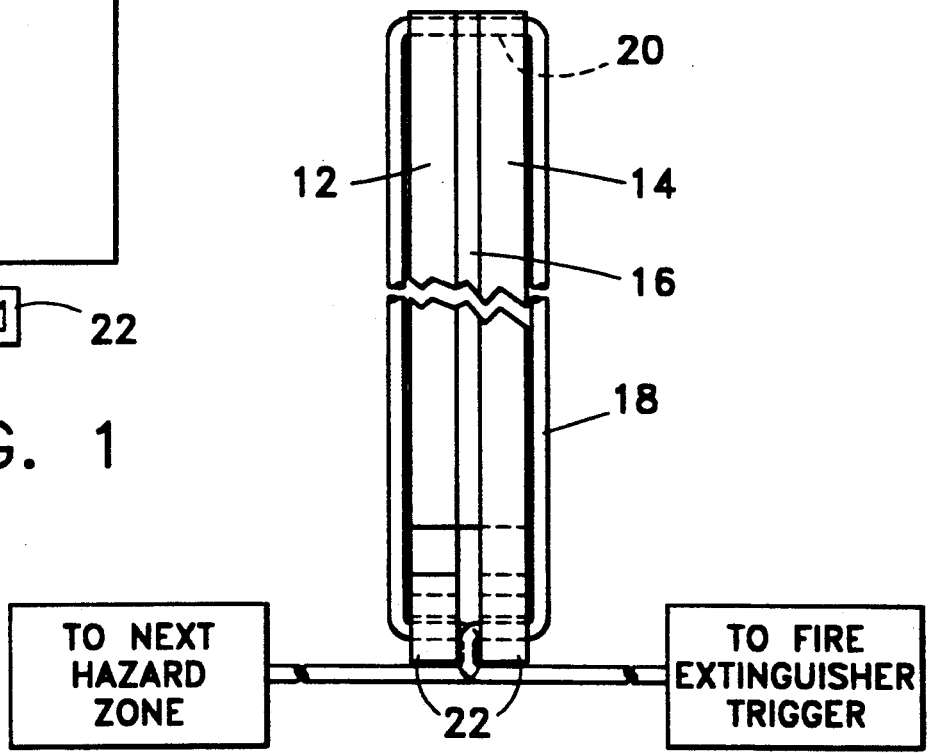
FIG. 2 is a side elevational view of the link shown in FIG. 1 with the thicknesses of the various parts being greatly exaggerated for clarity.
Figure 3:
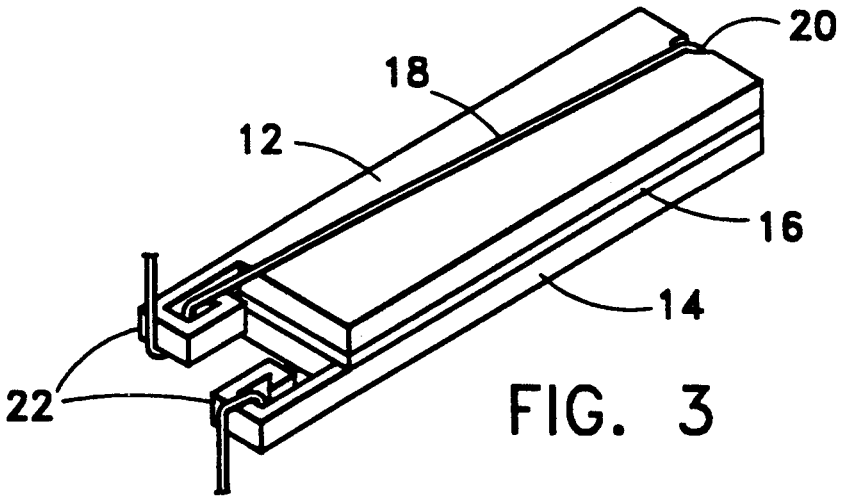
FIG. 3 is a perspective view of a fusible link of the invention as it would appear in use.

At one end the short, cross dimension of each of the leaves 12 and 14 is notched as at 20, and at its other end each leaf is shaped to form a hook-like guide 22. Preferably each of the guides 22 is made slightly shorter than half the width of the leaf 12 or 14. In this way the leaves 12 and 14 need not be enantiomorphic, but may be identical so that as viewed in FIG. 1 a second leaf may be laid upon the first link (shown) with its guide 22 on the right, opposite from the guide 22 of the first leaf.

In use the tensioned trip wire 18 is trained through the guides 22, along the lengths of the leaves 12 and 14 and through the notch 20, taking up a length of the wire about equal to twice the length of the link. With the guides 22 on opposite respective sides of the link, as viewed in FIG. 1, the opposite throws of the wire 18 do not interfere with each other at the guides.

A separate link is placed in the wire at each danger point in the region to be protected.

When the temperature at any of the danger points exceeds the predetermined value, typically in the range of about 150° to 5000° F., the link at that point fuses, allowing the leaves 12 and 14 to be pulled apart by the tensioned wire 18, triggering the extinguisher system as the overall length of the wire increases.

The exact shape and form of the leaves is not critical in the practice of the invention but largely a matter of designer's choice. It is thought that the shape shown and described herein may be advantageous from a cost viewpoint, requiring only a single cutout die to form. The important point is the elimination of separate parts, the combining of the take-up link and the fuse into a single unit without separate parts to be handled and controlled during installation. (The only movement of the parts relative to each other occurs after fusion upon the automatic disassembly of the link in response to a fire.)

What is claimed is:

1. A link for use in a fire protection system of the kind in which an increase in the overall length of a flexible tension member serves to trigger the system, said link comprising a pair of generally similar plates, each said plate including guideway means unitary therewith for holding the tension member in a predetermined non-rectilinear configuration extending along at least one face of each of said plates when said plates are secured together, said plates being secured together by an adhesive fusible material having a preselected melting temperature so that when the link is heated to said melting temperature the fusible material melts allowing the plates to separate, said guideway means being shaped so that when the plates are separated they are unable to restrain the tension member in said predetermined non-rectilinear configuration.

2. In a fire protection system of the kind having an elongated wire, means for holding the wire in tension so long as its overall length remains constant, and means for connecting the wire to a fire extinguished to trigger it in response to an increase in the overall length of the wire, the improvement comprising a link in the form of an integral body having laminations for holding the wire in a non-rectilinear configuration so long as the ambient temperature remains below a predetermined value, the laminations of said body being secured together by an adhesive, fusible material selected from among materials that melt at about said predetermined value, and said laminations having retaining means unitary therewith for restraining the wire in said non-rectilinear configuration so long as the laminations remain secured together and without the ned for operative parts separate from the link.

* * * * *